US008596454B1

(12) United States Patent
Carlson

(10) Patent No.: US 8,596,454 B1
(45) Date of Patent: Dec. 3, 2013

(54) CONTAINER FOR A LADDER

(76) Inventor: David C. Carlson, Vero Beach, FL (US)

( * ) Notice: Subject to any disclaimer, the term of this patent is extended or adjusted under 35 U.S.C. 154(b) by 0 days.

(21) Appl. No.: 13/374,751

(22) Filed: Jan. 10, 2012

Related U.S. Application Data

(60) Provisional application No. 61/461,140, filed on Jan. 14, 2011.

(51) Int. Cl.
*B65D 85/28* (2006.01)
*A47F 7/00* (2006.01)
*E06C 7/14* (2006.01)

(52) U.S. Cl.
USPC ..... 206/373; 182/129; 211/70.6; 248/210; 248/238

(58) Field of Classification Search
USPC ..... 206/349, 372, 373, 379; 182/129; 211/70.6; 248/210, 211, 238
See application file for complete search history.

(56) References Cited

U.S. PATENT DOCUMENTS

| | | | | |
|---|---|---|---|---|
| 3,642,240 | A | 2/1972 | Hershey | |
| 4,310,094 | A * | 1/1982 | Hotchkiss, Jr. | 211/70.6 |
| 5,333,823 | A * | 8/1994 | Joseph | 248/210 |
| 5,505,302 | A * | 4/1996 | Ferley | 206/373 |
| 5,603,405 | A | 2/1997 | Smith | |
| 5,613,574 | A * | 3/1997 | Melanson | 182/129 |
| 5,673,885 | A | 10/1997 | Pham | 248/210 |
| 5,740,883 | A | 4/1998 | Trank | |
| D395,523 | S | 6/1998 | Fine et al. | |
| 5,865,409 | A * | 2/1999 | Nimer | 248/210 |
| 6,098,748 | A | 8/2000 | Harper, Jr. et al. | |
| 6,467,577 | B1 | 10/2002 | Charlebois | |
| 6,536,557 | B2 | 3/2003 | Gibson et al. | |
| 6,564,941 | B2 | 5/2003 | Hodges | |
| 6,565,051 | B2 | 5/2003 | Vaglica | 248/210 |
| 6,823,998 | B2 * | 11/2004 | Fabregas | 206/373 |
| 7,032,711 | B1 | 4/2006 | Katz et al. | 182/129 |
| D547,460 | S | 7/2007 | Asham | |
| 7,374,018 | B1 * | 5/2008 | Thrun | 182/129 |
| D597,685 | S | 8/2009 | Gibson et al. | D25/68 |
| 7,798,336 | B2 * | 9/2010 | Shiao | 211/70.6 |
| 7,819,248 | B1 | 10/2010 | Takach | |
| 2002/0104709 | A1 | 8/2002 | Hines | |
| 2005/0258002 | A1 * | 11/2005 | Sabo | 182/129 |
| 2006/0163003 | A1 | 7/2006 | Wigstrom | |

* cited by examiner

*Primary Examiner* — Luan K Bui
(74) *Attorney, Agent, or Firm* — Richard O. Bartz

(57) ABSTRACT

A container mounted on the top step of a stepladder has a bottom wall joined to upright walls providing a chamber for holding tools, paint cans, parts and supplies. A ledge joined to an upright wall has holes and a slot to retain additional tools. Releasable fasteners secure the bottom wall to the top step of a stepladder.

15 Claims, 6 Drawing Sheets

CONTAINER FOR A LADDER

CROSS REFERENCE TO RELATED APPLICATION

This application claims the priority of U.S. Provisional Patent Application Ser. No. 61/461,140 filed Jan. 14, 2011.

FIELD OF THE INVENTION

The invention relates to containers, bins and boxes for holding tools and supplies attachable to ladders. The containers have tool supports to accommodate a versatility of tools and supplies used by trade and craft persons.

BACKGROUND OF THE INVENTION

Standard stepladders have been equipped with hooks, shelves and attachments to hold tools, supplies and paint cans for accessible use by workpersons. These adjuncts are attached to the sides, rungs and steps of ladders. Stepladders have top step and shelves that can accommodate hand tools and paint cans. Tools and supplies on ladders can fall off and injure persons, equipment and the floor. A safe, versatile, rugged and compact container for use with ladders is needed to hold tools, supplies and parts for all tradespersons including but not limited to electricians, plumbers, framers, painters, plasterers, paper hangers and maintenance persons. Examples of ladder supportable tool storage containers and tool boxes are disclosed in the following U.S. patents and patent publications.

R. W. Harper and T. J. Harper in U.S. Pat. No. 6,098,748 disclose a tool bin system for self supportive ladders having an adjustable length strap to allow a tool bin to be located at any height between the top and bottom of the ladder. A roll towel rack, winding spool, a utility tray, a hook and bin dividers are attached to the bin.

E. A. Charlebois in U.S. Pat. No. 6,467,577 discloses a tool box having a cover hinged to one side wall of the box. The cover includes a hook element cooperating with a top platform of a stepladder to hold the tool box adjacent the back of the ladder top platform.

K. J. Hines in U.S. Patent Application Publication No. US2002/0104709 discloses a toolbox having a base connected with a pair of straps to the top step of a stepladder. The tool box has upright internal walls providing three chambers for storing tools, supplies, small equipment, power tools and parts. A cover hinged to a back wall of the toolbox is movable to open and close the chambers of the toolbox.

J. Wigstrum in U.S. Patent Application Publication No. US2006/0163003 discloses a toolbox mounted on the top step of a stepladder. The top plate of the toolbox has a peripheral lip to retain objects on the top plate. A pair of open top housings are secured to opposite sides of the top plate. The housings are suspended on both sides of the top step of the stepladder and provide spaces for holding tools, brushes, paint cans and fasteners.

SUMMARY OF THE INVENTION

The invention is a multipurpose container for accommodating tools, parts and supplies in a safe and efficient location on a ladder for use by trade and craft persons. The container has a bottom wall joined to upright front, rear and end walls that surround a chamber for holding tools, paint cans, parts and supplies. One of the walls includes a ledge having a plurality of holes and a horizontal slot to hold tools on the ledge. The bottom wall has apertures that accommodate fasteners that releasably secure the bottom wall on the top step of a conventional step ladder. The apertures have keyhole shapes that allow the container to be laterally moved into holding engagement with the fasteners, such as bolts mounted on the top shelf of the step ladder. The bottom wall can be attached with fasteners, such as bolts and screws, to permanently retain the container on the top step of the step ladder. Alternatively, the top step of the stepladder can be part of the bottom wall of the container. The top step of the ladder and container can be a one-piece molded plastic member. The front and rear walls have outwardly curved inside wall surfaces that provide space for a paint can or pail in the chamber. At least one end wall and a rear wall has a plurality of horizontal holes that accommodate hooks, rods and attachments used to support additional tools and supplies. The container locates tools and supplies close to the ladder which enable the craft-person to use both hands for a job. The container secured to the top step of a step ladder provides the ladder with stability and balance. A craftperson is prevented from using the top step of the step ladder when the container is secured to the top step. The ladder can be folded up and stored without removal of the container from the ladder.

DESCRIPTION OF THE INVENTION

Figure 1:
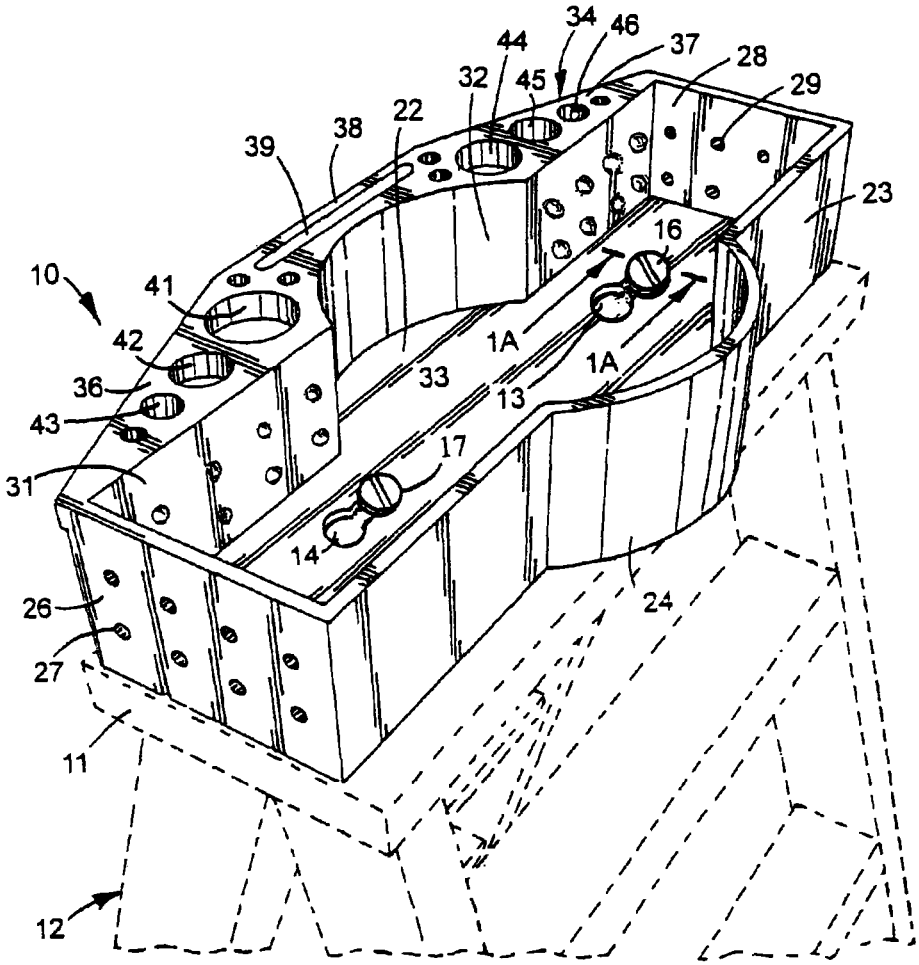
FIG. 1 is a perspective view of the container for holding tools and supplies mounted on a stepladder of the invention.
Figure 2:
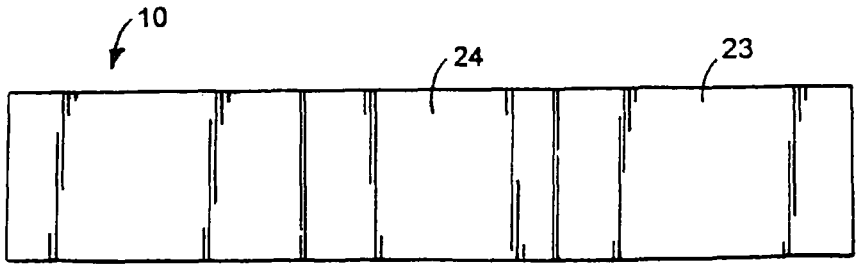
FIG. 2 is a front elevational view thereof.
Figure 3:
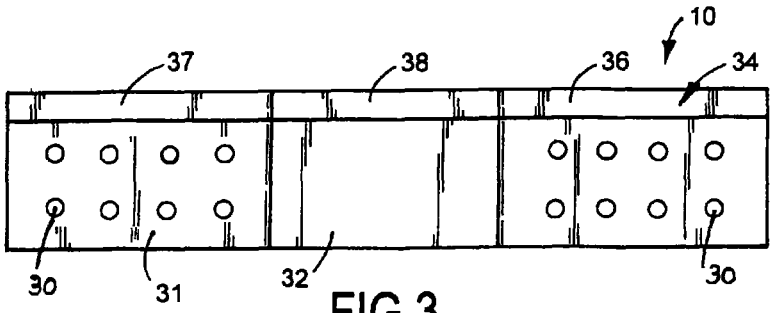
FIG. 3 is a rear elevational view thereof.
Figure 1A:
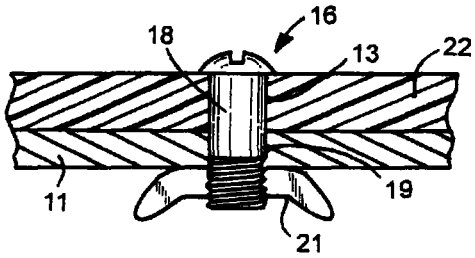
FIG. 1A is an enlarged sectional view taken along line 1A-1A of FIG. 1.
Figure 4:
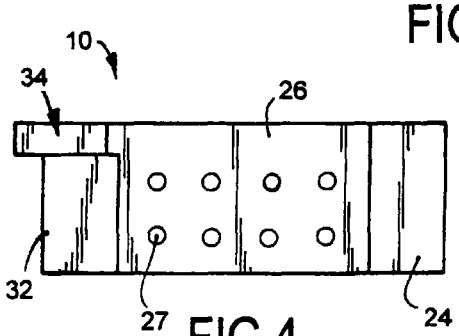
FIG. 4 is a side elevational view of the left side thereof.
Figure 5:
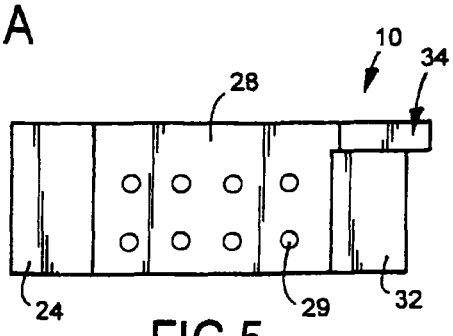
FIG. 5 is a side elevational view of the right side thereof.

A container 10 for holding tools and supplies, shown in FIG. 1, is supported on the top step 11 of a conventional stepladder 12. Container 10 has a pair of keyhole-shaped apertures accommodating fasteners 16 and 17 that releasably hold container 10 on the top surface of top step 11. Fasteners 16 and 17 are identical in structure and function. As shown in FIG. 1A, fastener 16 is a bolt 18 extended through keyhole-shaped aperture 13 and a hole 19 in top step 11 of ladder 12. A wing nut 21 threaded on bolt 18 clamps container 10 in tight surface engagement with the top of top step 11. When wing nut 21 is released container 10 can be laterally moved to release fasteners 16 and 17 allowing container 10 to be removed from stepladder 12. The fastener can be releasable hook and loop members. Fasteners, such as bolts, rivets and screws, can also be used to secure container 10 on the top step 11 of ladder 2. The top step of the ladder can be joined with an adhesive to container 11. The container 11 on top step of the ladder can be a molded plastic one-piece member.

Container 10 has a flat generally rectangular bottom wall 22 with keyhole-shaped apertures 13 and 14. Joined to bottom wall 22 is an upright front wall 23. The middle section of front wall 23 has an outwardly convex curved portion 24. A first end wall 26 with a plurality of holes 27 and a second end wall 28 with a plurality of holes 28 are joined to opposite ends of bottom wall 22 and front and back walls 23 and 31. Rear wall 31 has a plurality of horizontal holes 30. Holes 27 and 29 are Cartesian arranged in horizontal rows of holes. Hooks and rods (not shown) extend into holes 27, 29 and 30 provide supports for tools and equipment. An upright rear wall 31 having an outwardly convex curved middle portion 32 is joined to bottom wall 22 and end walls 26 and 27. Walls 23, 26, 28 and 31 have the same height and surround an open top chamber or space 33 for accommodating paint cans, pails, tools, supplies and parts.

Figure 6:
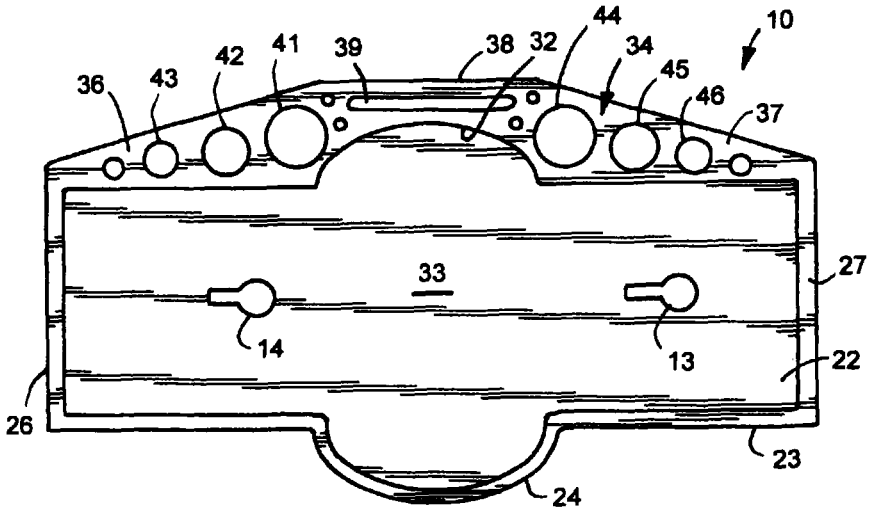
FIG. 6 is a top plan view thereof.
Figure 7:
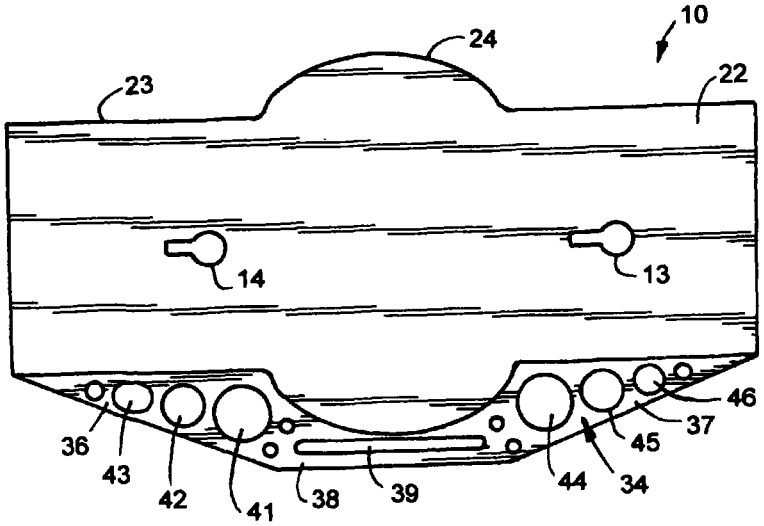
FIG. 7 is a bottom plan view thereof.

As shown in FIGS. 1 and 6, outwardly convex shaped wall portions 24 and 32 are transversely aligned allowing a paint can, such as a gallon paint can or pail to be supported on bottom wall 22 between the inside surfaces of wall portions 24 and 32.

A shown in FIGS. 1 and 3 to 7, a horizontal ledge or shelf 34 is joined to the upper portion of rear wall 31. Ledge 34 has side sections extended horizontally from a middle section 38. The middle section 38 has a horizontal slot 39 to accommodate a blade tool. Side section 36 has a plurality of openings or holes 41, 42 and 43 having different diameters. Hole 41 adjacent middle section 38 has a large diameter to accommodate a power tool, such as a power drill. Side section 37 also has a plurality of openings or holes 44, 45 and 46 having different diameters. Hole 44 adjacent middle section 38 has the largest diameter. The size and shape of the holes can vary to accommodate different types of tools. Holes 41-46 extend through ledge 34 whereby tools such as screwdrivers, scraping blades, putty knives and scrapers can be retained on ledge 34.

Container 10 is a one-piece rigid structure. The bottom wall 22, front wall 23, end walls 26 and 28, rear wall 31 and ledge 34 are made by injection molding of plastic material. The plastic material is a polymeric material from a group consisting of polyethylene, polypropylene, polycarbonate and polystyrene. A preferred material is impact modified polypropylene which is strong, impact resistant, cold and heat resistant and relatively easy to manufacture with an injection molding process. Other materials including metal, wood and recycled products can be used to fabricate container 10.

Figure 8:
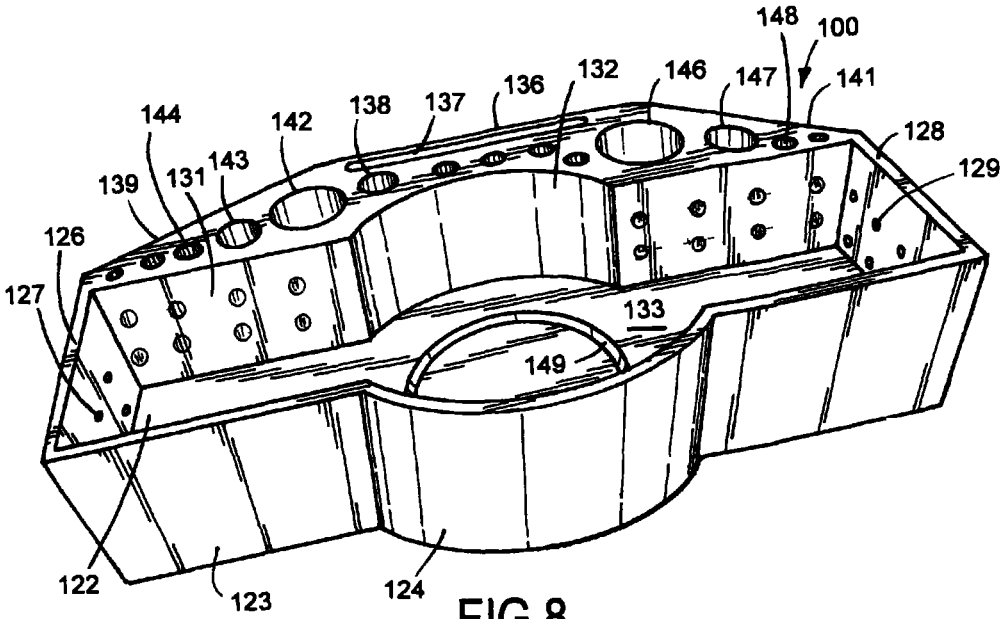
FIG. 8 is perspective view of a modification of the container for holding tools and supplies of FIG. 1.
Figure 9:
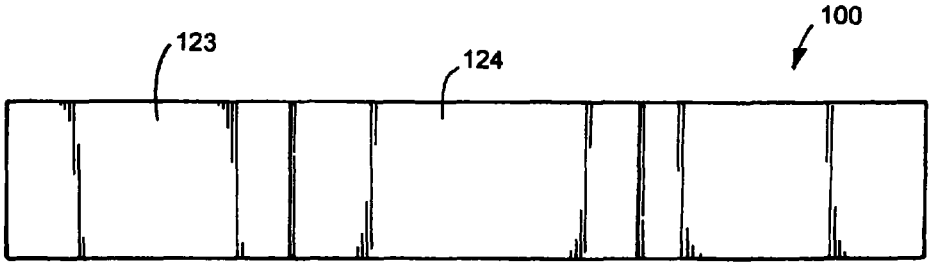
FIG. 9 is a front elevational view of FIG. 8.
Figure 10:
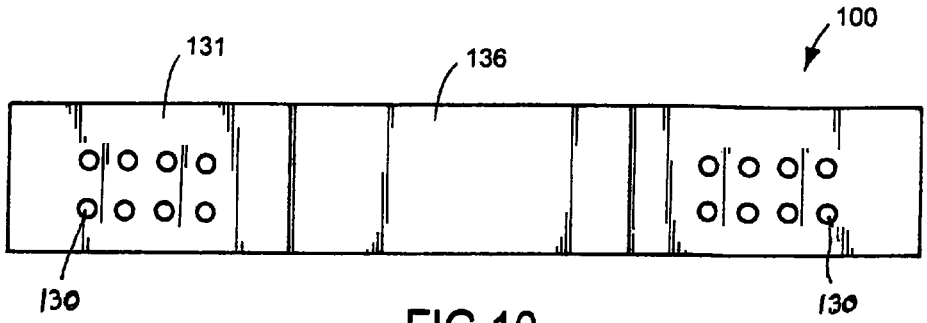
FIG. 10 is a rear elevational view of FIG. 8.
Figure 11:
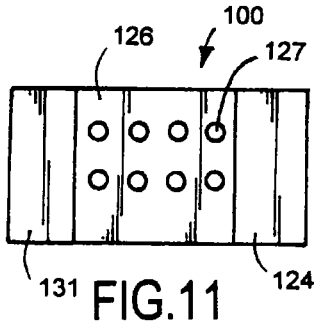
FIG. 11 is a side elevational view of the left side of FIG. 8.
Figure 12:
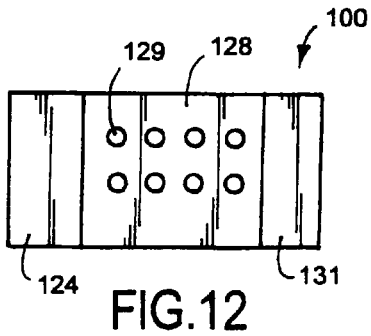
FIG. 12 is a side elevational view of the right side of FIG. 8.
Figure 13:
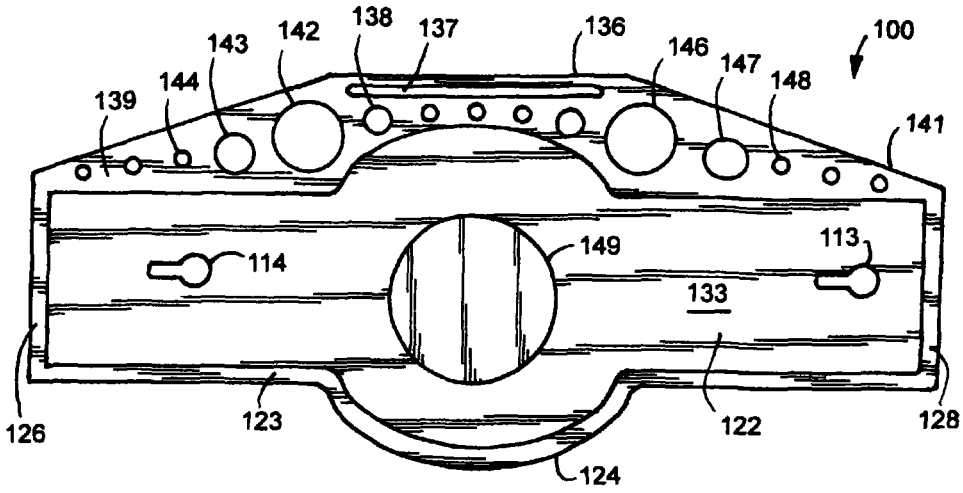
FIG. 13 is a top plan view of FIG. 8.
Figure 14:
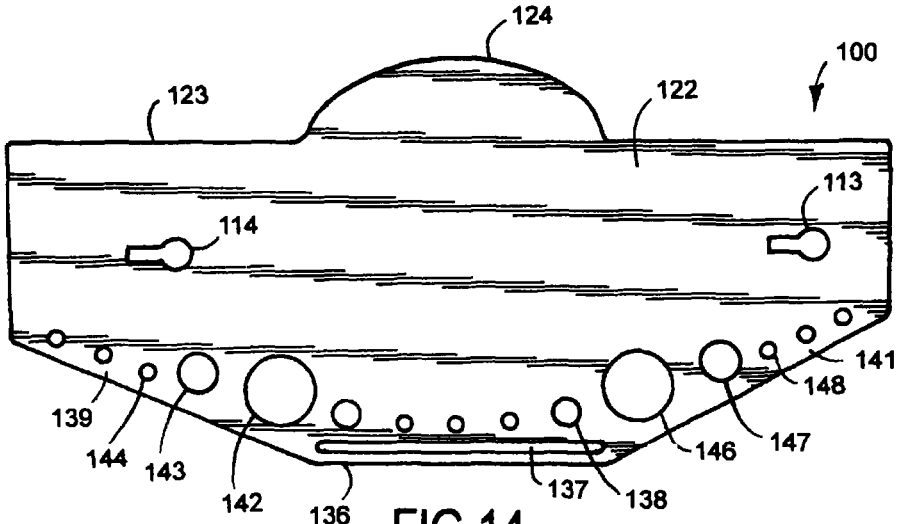
FIG. 14 is a bottom plan view of FIG. 8.

A modification of the container is shown in FIGS. 8 to 14. Container 100 is a one-piece member having a flat horizontal bottom wall 122 with a pair of keyhole apertures 113 and 114 to accommodate fasteners, such as fasteners 16 and 17 shown in FIG. 1. The fasteners are adapted to releasably connect container 100 to a support, such as the top step of a stepladder. Hook and loop members can be used as releasable fasteners to retain container on the top step of the ladder. Joined to bottom wall 122 is an upright front wall 123. As shown in FIGS. 8 and 13, front wall 123 has an outwardly convex curved middle portion 124. A first end wall 126 having a plurality of holes 127 and a second end wall 128 having a plurality of holes 129 are joined to opposite ends of bottom wall 122 of front wall 123. An upright rear wall 131 has a plurality of horizontal holes 130 and a concave curved inside surface 132 facing the middle portion 124 to provide space for a gallon paint can or pail. Hooks, rods and attachments (not shown) extend into holes, provide supports for tools and equipment for use by the tradesperson. The center of bottom wall 127 has a circular recess 149 to accommodate small paint cans and pails. Walls 122, 123, 126, 128 and 131 surround an open top chamber 133 for holding tools, supplies and parts used by workpersons.

The back wall 131 has a top 134 with a middle section 136 and side sections 139 and 141. Middle section 136 has a horizontal slot 137 for accommodating blade tools, putty knives, flat scraper tools, hawks and hammers. A plurality of holes 138 are located adjacent slot 137 for holding additional tools. Side section 139 has a plurality of vertical holes 142, 143 and 144 having different diameters. Hole 142 has a large diameter to accommodate a power tool, such as an electric drill. Side section 141 has a plurality of vertical holes 146, 147 and 148. Hole 146 has a large diameter to accommodate a power tool. The arrangement and sizes of the holes can be altered. The large diameter holes are used to support heavy plaster's trays, called hawks, flat on the metal platter to keep the plaster from sliding off the platter.

Container 100 is a one-piece structure made by injection molding of plastic material. A preferred material is impact modified polypropylene. Other materials can be used to fabricate container 100. The plastic material can be a polymeric material from a group consisting of polyethylene, polypropylene, polycarbonate and polystyrene.

Containers 10 and 100 affords a workperson to use a stepladder to hold tools, supplies and parts while on or in the vicinity of the stepladder. The containers are secured with fasteners to the stepladder in a manner that they cannot come loose. The fasteners can be released to allow the containers to be removed from the stepladder. The workperson can load up the containers at ground level, place the containers on the top step of the stepladder, and then slide the containers into locking engagement with the fasteners on the top step of the stepladders. The location of the containers on the top step of stepladders prevents a workperson from using the top steps as a foot rest or seat. The containers secured to the stepladders allows the stepladders to be folded up and stored in a conventional manner without the removal of the containers.

Plasterers, using hawks full of plaster, hold the hawks with one hand while plastering with the other hand. Using the containers 10 and 100, a hawk holding plaster, can insert the hawk handle into one of the large holes and thereby freeing one hand for balance.

Drywall tradespersons can place tape and a tray with the chambers of the containers 10 and 100. Rods can be inserted into the holes in the end walls to support one or more rolls of reinforcing tape on either side of the containers.

Painters can use the containers to hold standard one-gallon paint cans. The paint cans are retained on the bottom walls by the outwardly curved upright side walls of the containers. Smaller pint and quart trim paint cans can also be supported on the bottom walls of the containers thereby allowing several colors of paint to be applied to a surface by the painting workperson.

Several embodiments of the container for holding tools and supplies on a ladder have been shown and described. Changes, modifications and materials of the containers can be made by persons having skill in the art without departing from the scope and content of the invention as hereinafter claimed.

The invention claimed is:

1. A container for holding tools and supplies mountable on the top step of a stepladder comprising:

said container including a generally flat bottom wall adapted to be supported on the top step of the stepladder, said bottom wall having at least one aperture for accommodating a fastener for securing the bottom wall to the top step of the stepladder, upright front, rear and opposite end walls joined to the bottom wall surrounding a chamber having an open top for accommodating tools and paint cans and supplies, at least one of the upright end walls having a plurality of horizontal holes open to the chamber for accommodating supports for holding tools, and said upright front and rear walls include outwardly convex curved middle sections having arcuate concave curved inside wall surfaces laterally spaced from each other and adapted to accommodate a cylindrical paint can and retain the paint can on the bottom wall of the container, a horizontal ledge joined to said upright rear wall extended outwardly away from the rear wall, said ledge having a top horizontal surface coextensive with the top of the upright rear wall, and a plurality of generally vertical holes and a slot open to the top surface of said ledge for accommodating tools to support the tools on the container.

2. The container of claim 1 wherein:

the bottom wall has a pair of spaced apertures, each aperture having a keyhole shape adapted to accommodate a fastener for securing the bottom wall flat against the top step of the stepladder.

3. The container of claim 1 wherein:

said upright end walls include Cartesian arranged horizontal rows of holes.

4. The container of claim 1 wherein:

the bottom wall, upright front, rear and end walls and ledge have substantially the same thickness and are formed as a one-piece of injection molded rigid plastic material.

5. The container of claim 4 wherein:

the plastic material is polypropylene plastic.

6. The container of claim 4 wherein:

the plastic material is a polymeric material from a group consisting of polyethylene, polypropylene, polycarbonate and polystyrene plastics.

7. A container for holding tools and supplies mountable on a step of a ladder comprising:

said container including a bottom wall adapted to be supported on the step of a ladder, said bottom wall having at least one aperture for accommodating a fastener for securing the bottom wall to the step of the ladder, upright front and rear walls joined to the bottom wall, said upright front and rear walls having outwardly extended middle sections with outwardly arcuate curved inside wall surfaces laterally spaced from each other and adapted to accommodate a cylindrical paint can and retain the paint can on the bottom wall of the container, upright end walls joined to the front, rear and bottom walls, said upright front and rear walls and upright end walls surrounding a chamber having a top opening for accommodating tools and supplies, at least one of the upright end walls having a plurality of horizontal holes for accommodating supports for holding tools, said rear wall having a horizontal upper portion, a generally flat horizontal ledge joined to the upper portion of the rear wall, said ledge having a top horizontal surface coextensive with the top of the rear wall, a horizontal slot in said ledge open to the top surface of the ledge for accommodating a blade tool, and a plurality of downwardly extending holes in said ledge for accommodating tools.

8. The container of claim 7 wherein:

said plurality of downwardly extending holes are cylindrical holes having different diameters.

9. The container of claim 7 wherein:

the bottom wall has a pair of spaced apertures, each aperture having a keyhole shape adapted to accommodate a fastener for securing the bottom wall flat against the step of the ladder.

10. The container of claim 7 wherein:

each of said upright end walls having a plurality horizontal holes for accommodating supports for holding tools on the container.

11. The container of claim 7 wherein:

said plurality of downwardly extending holes are cylindrical holes.

12. The container of claim 7 wherein:

said end walls include Cartesian arranged horizontal rows of holes.

13. The container of claim 7 wherein:

the bottom wall, upright front, rear and end walls and ledge have substantially the same thickness and are formed as a one-piece of injection molded rigid plastic material.

14. The container of claim 13 wherein:

the plastic material is polypropylene plastic.

15. The container of claim 13 wherein:

the plastic material is a polymeric material from a group consisting of polyethylene, polypropylene, polycarbonate and polystyrene plastics.

* * * * *